US011598030B2

(12) United States Patent
Fiorina

(10) Patent No.: US 11,598,030 B2
(45) Date of Patent: Mar. 7, 2023

(54) DEVICE AND METHOD FOR MANUFACTURING CRIMPED TEXTILE YARN AND COOLING DRUM FOR SUCH A DEVICE

(71) Applicant: NV MICHEL VAN DE WIELE, Kortrijk/Marke (BE)

(72) Inventor: Claudio Fiorina, Sondrio (IT)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 455 days.

(21) Appl. No.: 16/463,359

(22) PCT Filed: Nov. 21, 2017

(86) PCT No.: PCT/IB2017/057278
§ 371 (c)(1),
(2) Date: May 22, 2019

(87) PCT Pub. No.: WO2018/096442
PCT Pub. Date: May 31, 2018

(65) Prior Publication Data

US 2019/0352810 A1 Nov. 21, 2019

(30) Foreign Application Priority Data

Nov. 22, 2016 (BE) ..... 2016/0172

(51) Int. Cl.
*D02J 13/00* (2006.01)
*D02G 1/16* (2006.01)

(52) U.S. Cl.
CPC ..... *D02J 13/005* (2013.01); *D02G 1/161* (2013.01)

(58) Field of Classification Search
CPC ..... D02J 13/005; D02G 1/161; D02G 1/122; D02G 1/14; D02G 1/20; D02G 1/12;
(Continued)

(56) References Cited

U.S. PATENT DOCUMENTS 2,753,181 A * 7/1956 Anander ..... B65H 23/24 226/95
4,118,843 A 10/1978 Schippers et al.
(Continued)

FOREIGN PATENT DOCUMENTS

FR 2358494 A1 * 2/1978 ..... D02G 1/125
WO WO2015/181019 A1 12/2015
WO WO-2015181019 A1 * 12/2015 ..... D01D 13/00

OTHER PUBLICATIONS

International Search Report and Written Opinion dated Feb. 8, 2018.

*Primary Examiner* — Amy Vanatta
(74) *Attorney, Agent, or Firm* — Fresh IP PLC; Clifford D. Hyra; Aubrey Y. Chen

(57) ABSTRACT

A device and a method for manufacturing a synthetic yarn, in which at least two yarn plugs (1), (2), (3) are produced by texturing, are placed in a first zone (A) on the cooling surface (6*c*) of a rotating cooling drum (6), moved to a second zone (B) and form more than one winding (I),(II), in which the yarn plugs are kept in the second zone (B) by a gas stream ($F_B$) on the cooling surface (6*c*), and in which no gas stream or a less powerful gas stream is generated in an intermediate zone (C) in order to prevent the yarn plugs (1), (2), (3) from leaving the second zone (B).

18 Claims, 6 Drawing Sheets

(58) Field of Classification Search
CPC ..... D02G 1/168; D02G 1/205; D02G 1/006; D21F 3/10; B65H 51/02; B65H 51/005
USPC ..... 28/256, 257, 266
See application file for complete search history.

(56) References Cited

U.S. PATENT DOCUMENTS

| | | | | | |
|---|---|---|---|---|---|
| 4,301,578 | A * | 11/1981 | Dammann | D02G 1/205 | 28/256 |
| 4,558,497 | A * | 12/1985 | Oswald | D02G 1/20 | 28/257 |
| 4,908,919 | A | 3/1990 | Irvine | | |
| 5,974,777 | A * | 11/1999 | Davis | D02J 13/005 | 28/255 |
| 10,308,462 | B2 * | 6/2019 | Abney | B26D 7/018 | |
| 2006/0010667 | A1 | 1/2006 | Jahns et al. | | |
| 2007/0084580 | A1 * | 4/2007 | Kahl | D21F 3/105 | 162/368 |
| 2009/0249765 | A1 * | 10/2009 | Stundl | D02G 1/12 | 57/246 |
| 2018/0187346 | A1 * | 7/2018 | Matthies | D02G 1/12 | |

* cited by examiner

DEVICE AND METHOD FOR MANUFACTURING CRIMPED TEXTILE YARN AND COOLING DRUM FOR SUCH A DEVICE

This application is a National Phase entry of International Application No. PCT/IB2017/057278 under § 371 and claims the benefit of Belgian patent application No. BE2016/0172, filed Nov. 22, 2016, which is hereby incorporated by reference in its entirety.

FIELD OF THE INVENTION

The present disclosure relates, on the one hand, to a device for manufacturing crimped textile yam, comprising a texturing unit provided to produce at least two yarn plugs from synthetic material, a rotatable cooling drum with a cooling surface for cooling the yarn plugs supplied from the texturing unit, and gas stream means provided to generate a gas stream to keep yarn plugs on the cooling surface, and in which the device is provided to place the supplied yam plugs next to each other in a first zone of the cooling surface on the rotating cooling drum, so that they are carried along running alongside each other on the cooling surface, in order to move the yam plugs running alongside each other laterally to a second zone of the cooling surface during their first turn on the cooling drum, so that the supplied yam plugs are placed on the cooling surface at an intermediate distance from the yarn plugs running alongside each other which have been moved to the second zone, and to lead the yarn plugs away from the cooling drum for their further treatment after forming more than one winding of yarn plugs running alongside each other on the cooling drum.

On the other hand, the present disclosure also relates to a method for manufacturing crimped textile yarn, in which at least two yam plugs are produced from synthetic material in a texturing unit, in which the yarn plugs are placed in a first zone on the cooling surface of a rotating cooling drum, so that they are carried along running alongside each other on the cooling surface, in which the yarn plugs running alongside each other are moved laterally to a second zone on the cooling surface during their first turn on the cooling drum, in which the yarn plugs are kept on the cooling surface by means of a gas stream, and in which the yarn plugs running alongside each other are lead away from the cooling drum for further treatment after having formed more than one winding.

The present disclosure also relates to a cooling drum for a device for manufacturing crimped textile yarn, comprising a body which is rotatable with respect to an axis and has a sleeve on which a cooling surface is provided for cooling at least two yarn plugs supplied from a texturing unit.

BACKGROUND

During the production of synthetic yarns, separate filaments are produced from a thermoplastic, such as e.g. polypropylene, polyester or polyamide. This is performed using an extrusion process. A number of these filaments are combined to form a so-called multifilament yarn. It is known to improve the properties of a multifilament yarn through texturing in order to make it more suitable for certain applications. This is achieved, for example, by bringing a heated gaseous medium, such as hot air, near the filaments at high speed in a texturing channel. As a result thereof, the filaments are moved in the texturing channel and are deformed in a downstream part of the texturing channel.

Subsequently, the yarn is set, so that a crimped yarn is obtained. This makes the yarn more voluminous and gives it a better covering power, which is highly advantageous for synthetic yarns which are used for weaving or tufting carpets.

Known texturing devices comprise a texturing unit in which two or more texturing channels are provided next to each other. In each channel, a respective multifilament yarn is introduced via a supply opening into the channel. Each channel is provided with an air inlet via which hot air is blown into the texturing channel at great speed. This air has a temperature which is sufficiently high to bring the synthetic material to a processing temperature at which the plastic is soft and deforms easily. In a well-defined zone, the texturing channels are wider and provided with outlet openings via which the air can escape. The yarn is carried along by the hot air in the texturing channels. In the wider zones of these channels, the speed of the air and the yarn decreases significantly, as a result of which the yarn is compressed to form a yarn plug, and from that point on moves in the channel as a yarn plug and eventually leaves the texturing channel via a discharge opening. Subsequently, the yarn plugs are placed in the form of a continuous supply from the texturing unit onto the cylindrical cooling surface of a cooling drum to cool down, and then, after more than one turn, they are lead away again from the cooling surface to be subjected to additional treatments and ultimately wound onto bobbins as a crimped textile yarn. In this case, the yarn is lead away from the cooling surface at a greater speed than the supply speed of the yarn plugs, so that the yarn plugs are converted to a stretched crimped yarn.

In a texturing device which is known from Belgian patent BE 1 021 905, the sleeve surface of the cooling drum which functions as a cooling surface is flat and uninterrupted and the cooling surface is provided with perforations which are evenly distributed across the entire surface. Under the sleeve surface, a drawing-in device is provided by means of which air can be drawn in to generate an air stream which flows from the top side of the cooling surface through the perforations. This air stream which is directed towards the cooling surface exerts a force on the yarn plugs which are situated on the cooling surface, as a result of which the yarn plugs are pushed against the cooling surface. The air stream also ensures a quick and even cooling of the yarn plugs. As a result of the cooling, the deformations of the filaments are set.

The simultaneously produced yarn plugs are placed in a first zone of the perforated cooling surface of the slowly rotating cooling drum, so that they run alongside each other, and are carried along by this rotating sleeve surface for more than one complete turn. Just before the second turn starts, the yarn plugs running alongside each other are moved laterally by a guide surface situated above the cooling surface. At the start of the second turn, the yarn plugs are consequently in a second zone of the perforated cooling surface, next to the first zone.

Subsequently, after they have been carried along over the cylindrical sleeve surface for more than one turn, the yarn plugs running alongside each other are lead away from this surface. The yarn plugs are not necessarily on the cooling drum for an integer number of turns and may be lead away from the transport surface at any location before the last turn is completed, for example after 1.3 turns or after 1¾ or after 2½ turns. The number of turns is determined as a function of the speed of rotation of the cooling drum and of the time which is required to allow the yarn plugs to cool down sufficiently.

At each turn, the two or more yarn plugs originating from the various texturing channels run next to each other in a group. In this case, the yarn plugs always maintain the same sequence within the group. A first part of these yarn plugs running alongside each other, with a length which essentially corresponds to the circumference of the cylinder sleeve, makes a first turn, a second part makes a second turn, a third part makes a third turn, etc. After they have made a complete first turn, the second parts of the yarn plugs running alongside each other are moved laterally, so that they come to lie next to their first parts running alongside each other which are making the first turn on the sleeve surface. The third parts running alongside each other which are making the third turn run next to the second parts running alongside each other which are making the second turn, etc.

The properties of such a textured yarn are determined, inter alia, by the circumstances in which the yarn cools down after completing the texturing process. If two or more yarn plugs produced together cool down when running alongside each other, it is very important that they cool down in essentially identical circumstances and are treated in the same way in order to prevent excessive differences in the yarn quality of the simultaneously produced crimped textile yarns.

It has been found that, despite the existing measures to this effect, the yarn quality of the simultaneously produced textile yarns sometimes still differs to an excessive degree with the known texturing devices. It has been found that, when the texturing process is modified in order to limit these differences, small modifications to the process can result in significant differences in the yarn quality.

SUMMARY

It is an object of embodiments of the present invention to reduce the drawbacks of the known texturing devices by providing a texturing device by means of which two or more filament-type synthetic materials can be textured simultaneously in the same texturing unit for manufacturing crimped textile yarn, thus significantly reducing the risk of internal differences in the yarn quality of these synthetic yarns.

This object may be achieved by providing a device for manufacturing crimped textile yarn having the characterizing features which are indicated in the first paragraph of this description, the gas stream means of which are provided to generate a gas stream in the second zone of the cooling surface, so that the yarn plugs in this second zone are kept on the cooling surface, and not to generate a gas stream in an intermediate zone of the cooling surface, situated between the first and the second zone, or to generate a gas stream which is less powerful than in the second zone, in order to prevent interference between the yarn plugs in the second zone and the yarn plugs in the first zone.

The two or more yarn plugs formed together run next to each other in a group on the cooling surface and have first parts which make a first turn and second parts which make at least a part of a second and/or subsequent turns on the cooling surface. In each turn, the yarn plugs run in the same sequence next to each other on the cooling surface. Although the following explanation also applies to, for example, the third part of the yarn plugs in the third turn versus the second part of the yarn plugs in the second turn, the focus is only on the first and the second turn below for the sake of simplicity. A first part of the last yarn plug of the yarn plugs in the first turn runs next to a second part of the first yarn plug of the yarn plugs in the second turn.

These neighbouring parts of yarn plugs which are situated in successive turns can come into contact with each other as a result of the fact that their mutual filaments interhook or become entangled with each other, as a result of which a force is required to separate the yarn plugs from each other again. This may also occur between a yarn plug and a yarn or between two yarns. This phenomenon in which an interaction occurs between two yarn plugs or between two yarns or between a yarn plug and a yarn, as a result of which a force is required to separate the two yarn plugs or the yarn plug and the yarn or the two yarns from each other, is referred to in this patent application by the terms interference and interfere. The interaction consists of, for example, interhooking or entanglement of filaments, but other forms of interaction are not excluded.

Due to the interference, the second part of the first yarn plug moves at a different speed from the second parts of the other yarn plugs of the group of yarn plugs in the second turn.

As a result thereof, this yarn plug is longer than the other and the formed yarn is pulled from the cooling drum at a lower speed. As a result thereof, the quality of the yarn made from this yarn plug differs from the quality of the yarns which are made from the other yarn plugs. Due to the force which is exerted to separate the interhooked or entangled yarn plugs and/or yarn, the filaments from which the yarn plugs or the yarn are made are damaged or even broken. Certainly with yarns comprising many relatively fine filaments, many filaments are broken by this force. As a result thereof, the appearance of the formed yarn becomes less smooth and slightly hairy. Broken filaments may remain behind on the cooling surface which may hamper the cooling process. The broken filaments may also cause additional soiling of the extrusion line or other textile machines on which the yarn is processed during the further processing of the yarn, due to broken filaments breaking off and remaining behind, and/or disrupt the processes applied due to the fact that the yarn gets caught in the machine components more readily, as a result of which the filaments (or the yarns themselves) break and disrupt the production process or due to the fact that the yarn comes into contact with another yarn and their mutual filaments interhook or become entangled.

In the first zone, the yarn plugs are placed next to the yarn plugs moved to the second zone at an intermediate distance. In other words, the first part of the last yarn plug of the group is placed next to the second part of the first yarn plug at an intermediate distance apart. Initially, no contact between these neighbouring yarn plugs is therefore possible. However, the second part of the first yarn plug tends to move on the cooling surface in the direction of the neighbouring first part of the last yarn plug, so that there is nevertheless a risk of interference between these neighbouring yarn plugs after some time.

There may also be interference between the first part of the last yarn plug of the group and the crimped yarn which leaves the cooling drum from the neighbouring second part of the first yarn plug. The reason for this is that it is much easier for the yarn, which is much lighter than the yarn plugs, to make a lateral movement in the direction of the neighbouring first part of the last yarn plug of the group. The yarn may thus interfere with the yarn plug.

Due to the interference between the first part of the last yarn plug of the group and the neighbouring second part of the first yarn plug of the group, a pulling force has to be exerted. As a result thereof, the yarn which is pulled from the second part of the first yarn plug is pulled away from the cooling drum at a lower speed than the yarn which is pulled away from the second part of the other yarn plug(s) of the group. As a result thereof, the second part of the first yarn plug situated on the cooling drum is much longer than the other yarn plug(s) in the second turn. As a result thereof, the cooling of the first yarn plug proceeds differently to the cooling of the other yarn plug(s) and this leads to relatively large differences in the yarn quality of the yarns from these yarn plugs.

The relatively great differences in the yarn quality of simultaneously produced crimped synthetic yarns are mainly due to the interference between neighbouring yarn plugs of, for example, respectively the first turn and the second turn on the cooling drum or between a yarn plug of the first turn on the cooling drum and the yarn which is pulled away from the neighbouring yarn plug in the second turn of the cooling drum.

The yarn plugs of the first turn are situated in the first zone on the cooling surface and the yarn plugs of the second turn are situated in the second zone on the cooling surface. By generating a gas stream in the second zone of the cooling surface as a result of which the yarn plugs in this second zone are kept on the cooling surface, and by not generating a gas stream in an intermediate zone situated between the first and the second zone of the cooling surface or by generating a less powerful gas stream than in the second zone, the yarn plugs are kept in the second zone and they are efficiently prevented from moving out of the second zone.

The gas stream ensures, on the one hand, that the yarn plugs are kept in the second zone in a satisfactory manner. In addition, due to the difference in intensity of the gas stream in the second zone and the gas stream in the intermediate zone, or due to the fact that no gas stream is generated in this intermediate zone, lateral gas streams which are directed towards the second zone are generated in the intermediate zone, more particularly in the boundary zone in the vicinity of the boundary between the second zone and the intermediate zone. As a result thereof, a yarn plug which has a tendency to move from the second zone in the direction of the first zone comes under the influence of said lateral gas streams in this boundary zone, as a result of which its displacement is counteracted.

The difference in force between the gas streams in the second zone and the intermediate zone may be generated in any possible way, such as for example by creating the different air streams by means of separate drawing-in or blowing-in means having a different capacity or setting, by dividing a gas stream into two gas streams which are directed differently in the second zone and the intermediate zone or are subjected to a different flow resistance or are passed through passages of different sizes, or by not allowing a gas stream to pass through the intermediate zone. This may be achieved, for example, by at least partly covering existing openings or passages for the gas stream in the intermediate zone.

As a result thereof, the risk of the second part of the first yarn plug of the group or the yarn pulled therefrom moving laterally from the second zone and interfering with the first part of the last yarn plug of the group situated in the first zone is significantly smaller than with the known cooling drums. As a result thereof, the risk of interference with yarn plugs in the first zone is much smaller and the risk of internal differences in the yarn quality of simultaneously produced synthetic yarns is significantly reduced.

The gas stream is preferably directed towards the cooling surface. The gas stream is, for example, an air stream. The air stream may be generated by drawing in or blowing in air from the surroundings of the device. The cooling drum may be situated in a closed space and the air present in this space may be used to generate the air stream. In a possible embodiment, the temperature of the gas employed is controlled so as to stay within predetermined boundaries.

In a preferred embodiment of the device according to the present invention, the cooling surface in the second zone is permeable to gas and the gas stream means are provided to generate a gas stream through the second zone of the cooling surface which is directed towards the cooling surface. This makes it possible to generate an air stream which keeps the yarn plugs on the cooling surface in the second zone in a very efficient manner.

In a particular embodiment, the cooling surface in the first zone is permeable to gas, whereas the gas stream means are provided to generate a gas stream through the first zone of the cooling surface which is directed towards the cooling surface. As a result thereof, the yarn plugs are also kept in the first zone of the cooling surface in a very efficient manner. As a result thereof, the risk of the first part of the last yarn plug of the group moving laterally in the direction of the second zone becomes very small.

In a particularly preferred embodiment, the cooling surface in the intermediate zone is less permeable to gas than in the second zone or is not permeable to gas. Preferably, the cooling surface is also less permeable to gas in the intermediate zone than in the first zone. Preferably, the cooling surface in the intermediate zone has a substantially closed surface. Furthermore, the intermediate zone preferably also has at least the same width as said intermediate distance.

In a particular embodiment, the first and the second zone of the cooling surface are separated from one another by the intermediate zone over at least part of the circumference of the cooling surface. In another particular embodiment, the first zone and the second zone of the cooling surface form a respective band which extends over the circumference of the cooling surface and has a width which is at least equal to the width of the yarn plugs running alongside each other.

The widths of the first and the second zone are preferably equal over the entire circumference of the cooling drum. The first and the second zone are preferably of equal width.

In a highly preferred embodiment, the cooling surface is a flat and uninterrupted surface. In this case, there are preferably no grooves in the surface and/or no raised edges and the like. The diameter of the sleeve surface of the cooling drum preferably essentially has no modifications over the entire width of the first zone, the second zone and the intermediate zone of the cooling surface.

In a particularly preferred embodiment, one or more openings or perforations are provided in the first zone and in the second zone of the cooling surface, whereas the cooling surface in the intermediate zone is substantially closed.

The gas stream means may comprise, for example, a drawing-in device in order to create an underpressure under the cooling surface which generates an air stream which is directed from the top side of the cooling surface towards the cooling surface and flows through at least one gas-permeable zone thereof.

In an embodiment which is greatly preferred, the device comprises a guide wall which extends above the cooling surface at an angle in order to guide the yarn plugs running alongside each other to said second zone before they enter the second turn on the cooling surface.

The above objective may also be achieved by providing a method for manufacturing crimped textile yarn, having the characterizing features described in the second paragraph of this description, in which the yarn plugs are kept in the second zone on the cooling surface by a gas stream, and in which no gas stream is generated in an intermediate zone of the cooling surface which is situated between the first and the second zone or a gas stream which is less powerful than in the second zone is generated in order to prevent interference between the yarn plugs in the second zone and the yarn plugs in the first zone.

The way in which said object is achieved by applying this method is sufficiently evident from the foregoing. In a particular method according to the invention, use is made of the cooling drum according to embodiments of the present invention. Preferably, the method is carried out using the device for manufacturing crimped textile yarn according to embodiments of the present invention.

The above objective may also be achieved, according to embodiments of the present invention, by providing a cooling drum for a device for manufacturing crimped textile yarn, having the characterizing features indicated in the third paragraph of this description, in which the cooling surface is a flat and uninterrupted surface comprising a first zone and a second zone which are permeable to gas in order to allow a gas stream to pass through in order to keep at least two yarn plugs situated on the cooling surface on the cooling surface in each zone, and in which the first and the second zone are separated from one another by an intermediate zone which is less permeable to gas than the second zone or is not permeable to gas.

Such a cooling drum makes it possible to generate, in a simple and very efficient manner, a gas stream flowing through the cooling surface which is more powerful in the second zone of the cooling surface than in the intermediate zone, in order to keep the yarn plugs in this second zone on the cooling surface and to prevent, in an efficient way, a yarn plug from moving laterally and leaving the second zone.

The fact that it is possible to significantly reduce the risk of great internal differences in the yarn quality of simultaneously produced crimped synthetic yarns by using such a cooling drum is evident from the above description of a device for manufacturing crimped textile yarn in which such a cooling drum is used.

Here, we only repeat the fact that due to the difference in intensity of the gas stream in the second zone and the gas stream in the intermediate zone or due to the fact that no gas stream is generated in this intermediate zone, lateral gas streams can be generated in the intermediate zone, more particularly in the boundary zone in the vicinity of the boundary between the second zone and the intermediate zone, which lateral gas streams are directed towards the second zone. A yarn plug which has a tendency to move from the second zone in the direction of the first zone will consequently come under the influence of said lateral gas streams in this boundary zone, as a result of which its lateral displacement is counteracted.

Obviously, the following characterizing features of the cooling drum may also be provided in the cooling drum of the above-described device for manufacturing crimped textile yarn.

Preferably, the cooling surface is also less permeable to gas in the intermediate zone than in the first zone A.

In a highly efficient embodiment, said first zone, second zone and intermediate zone of the cooling surface have a respective width according to the direction of the axis, with both the width of the first zone and the width of the second zone being greater than the width of the intermediate zone.

The width of the first zone and the second zone are preferably approximately equal, whereas the width of the intermediate zone is preferably smaller than half the width of the first and the second zone. In a greatly preferred embodiment, the width of the intermediate zone is at most 35% of the width of the first zone and the second zone, more preferably at most 25% of the width of the first zone and the second zone.

In the most preferred embodiment, the cooling surface comprises, at least in the first and in the second zone, a number of openings for the passage of a gas stream, and the openings in the first and in the second zone are distributed over two or more parallel position lines which extend at right angles to the direction of the axis and may be indicated on the cooling surface.

The distribution of the openings over several adjacent position lines makes it possible, on the one hand, to keep the two or more yarn plugs running alongside each other in the second zone of the cooling surface more effectively and, on the other hand, to also generate lateral gas streams in a very efficient way which are, in the boundary zone of the intermediate zone, in the vicinity of the boundary between the intermediate zone and the second zone, directed towards the second zone and counteract a displacement of a yarn plug from the second zone in the direction of the first zone.

Said position lines are imaginary parallel lines on the cooling surface, at right angles to the direction of the axis, through the centre of one or more openings in the cooling surface.

The position lines preferably run parallel with the edges of the cooling surface. At least one opening is provided for each position line.

The openings are preferably distributed over at least five parallel position lines, the openings being arranged in rows which follow the axis, with a first row whose openings are situated on the odd (the first, the third, the fifth, . . . ) position lines alternating with a second line whose openings are situated on the even position lines (the second, the fourth, . . . ). Preferably, there are 13 position lines in the first zone and in the second zone. The openings may also be distributed over three position lines, in which case rows of two openings are formed on the first and the third position line, respectively, and there is in each case one intermediate opening situated on the central position line between two such rows.

The perpendicular intermediate space between the parallel position lines is smaller than the width of the intermediate zone.

In the most preferred embodiment, the first and the second zone of the cooling surface, running over at least part of the circumference of the cooling surface, are separated from one another by the intermediate zone.

The first zone and the second zone of the cooling surface then form, for example, a respective band of uniform width running over the circumference of the cooling surface.

The openings in the first zone and the openings in the second zone of the cooling surface are distributed in each zone over two or more position lines which form closed contour lines on the cooling surface.

If the cooling drum has a cylindrical sleeve on which the cooling surface is provided, the position lines are circular lines which follow the circumference of the cooling surface.

BRIEF DESCRIPTION OF THE DRAWINGS

In the following description, a method and a device for manufacturing crimped textile yarn according to the present invention are described in detail. The sole aim of this detailed description is to indicate how the invention may be implemented and to illustrate the particular characterizing features of the invention and, if necessary, provide a further explanation thereof. Therefore, this description can by no means be regarded as a limitation of the range of protection of this patent or of the area of application of the invention.

Reference numerals are used in this description to refer to the attached figures, in which.

DETAILED DESCRIPTION

Figure 1:
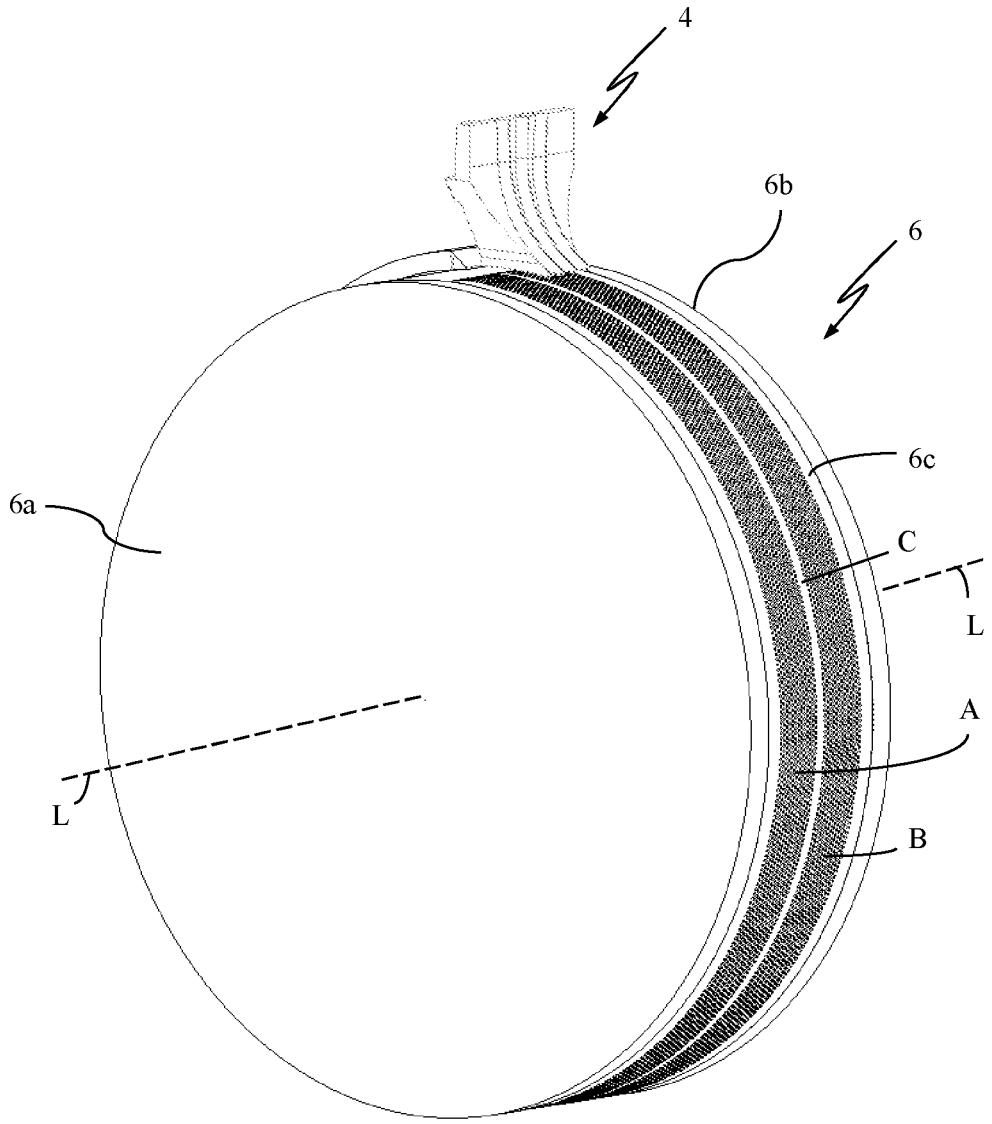
FIG. 1 shows a perspective view of a cooling drum and the discharge unit of a texturing unit of a device for manufacturing crimped synthetic yarn.
Figure 2:
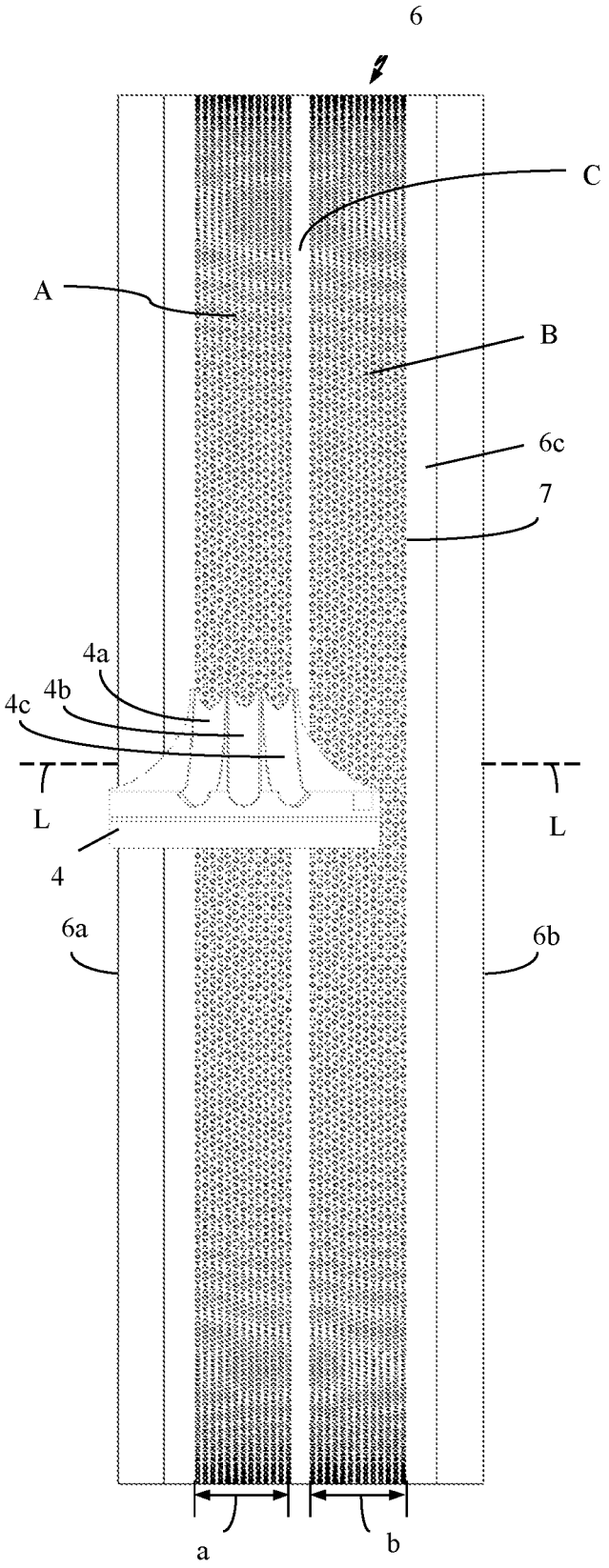
FIGS. 2 and 3 show a top view and a front view of that which is illustrated in FIG. 1.
Figure 3:
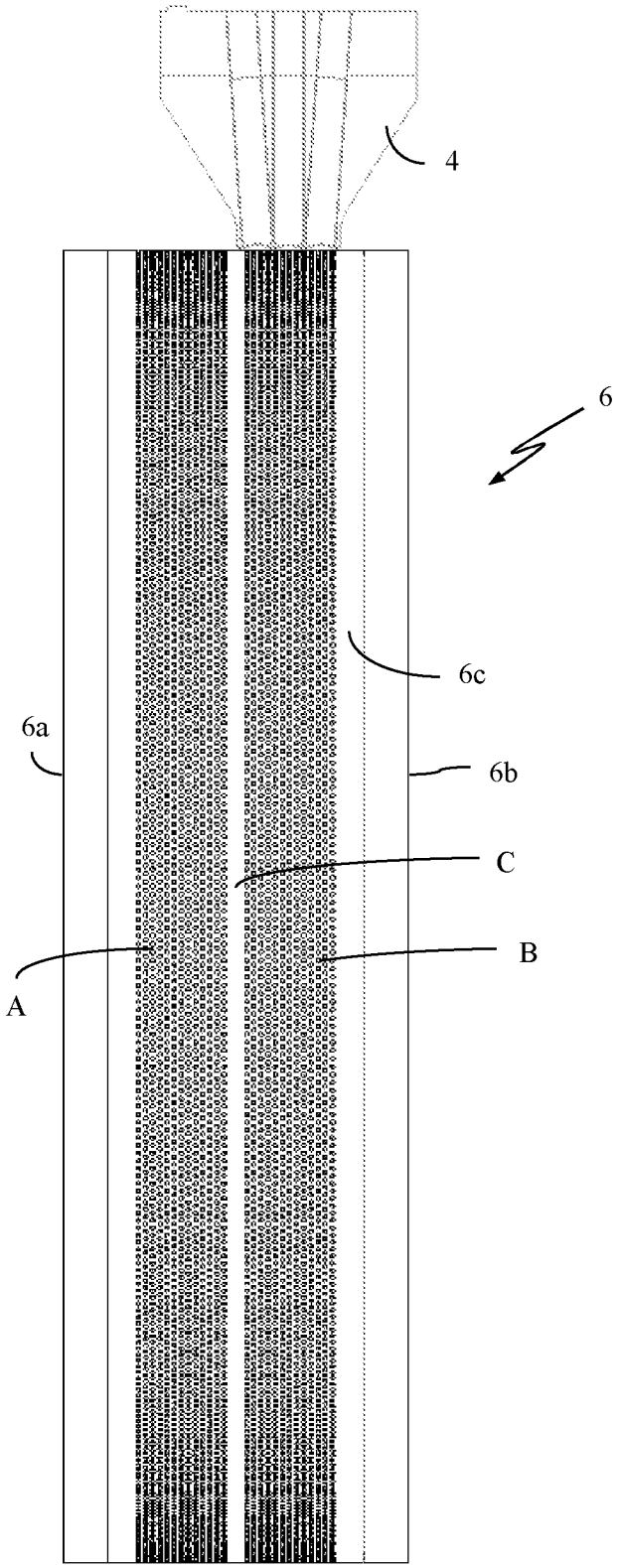

A preferred embodiment of a device for manufacturing crimped textile yarn comprises a texturing unit with three texturing channels for simultaneously forming three yarn plugs (1), (2), (3) and a cooling drum (6) with two circular flanks (6*a*), (6*b*) and a cylindrical sleeve surface which functions as a cooling surface (6*c*). The yarn plugs leave the texturing unit via a common discharge unit (4) with three channels (4*a*), (4*b*), (4*c*) and are arranged on the cooling surface (6*c*) of the cooling drum (6) rotating about its axis (L).

The cylindrical cooling surface (6*c*) extends between two raised edges formed by the flanks (6*a*), (6*b*), is flat and uninterrupted and, in other words, is free from grooves, channels or raised edges which interrupt the surface. The cooling surface (6*c*) has two zones (A), (B) which are provided with perforations (7). These zones (A), (B) are provided symmetrically on either side of the centre of the cooling surface (6*c*) and extend over the entire circumference of the sleeve surface (6*c*) and are of essentially equal width (a), (b).

Between these two zones (A), (B), an intermediate zone (C) is provided in which the cooling surface does not have perforations and is provided with a closed surface. The width (c) of the intermediate zone (C) is the same over the entire circumference of the sleeve surface (6*c*) and is much smaller than the widths (a), (b) of the zones (A), (B) with perforations.

In the two zones (A), (B) comprising perforations, the perforations are distributed over a number of parallel position lines ($P_1$), ($P_2$), ($P_3$), ($P_4$), ($P_5$), ($P_6$) which may be indicated as running on the sleeve surface parallel to the edges of the cylindrical cooling surface (6*c*). The perpendicular intermediate space (w) between these position lines is much smaller than the width (c) of the intermediate zone (C). Under the cooling surface (6*c*), there is a drawing-in device (8) which is provided to take in ambient air, so that air streams ($F_A$), ($F_B$) are generated which flow from the top side of the cooling surface (6*c*) through the perforations (7) (see FIG. 5). These air streams directed towards the cooling surface (6*c*) exert a downward force on the yarn plugs (1), (2), (3) arranged on the cooling surface. Due to the open structure of the yarn plugs, a significant amount of air flows through the yarn plugs.

The three yarn plugs (1), (2), (3) running alongside each other are placed in a continuous supply on the first zone (A) on the cooling surface (6*c*) of the rotating cooling drum and are carried along by the cooling surface, so that they form, while running alongside each other , a first complete winding (I) and a part of a second winding (II). The yarn plugs running alongside each other in this case have a width (x) which is smaller than or equal to the widths (a), (b) of the first (A) and the second zone (B).

Figure 4:
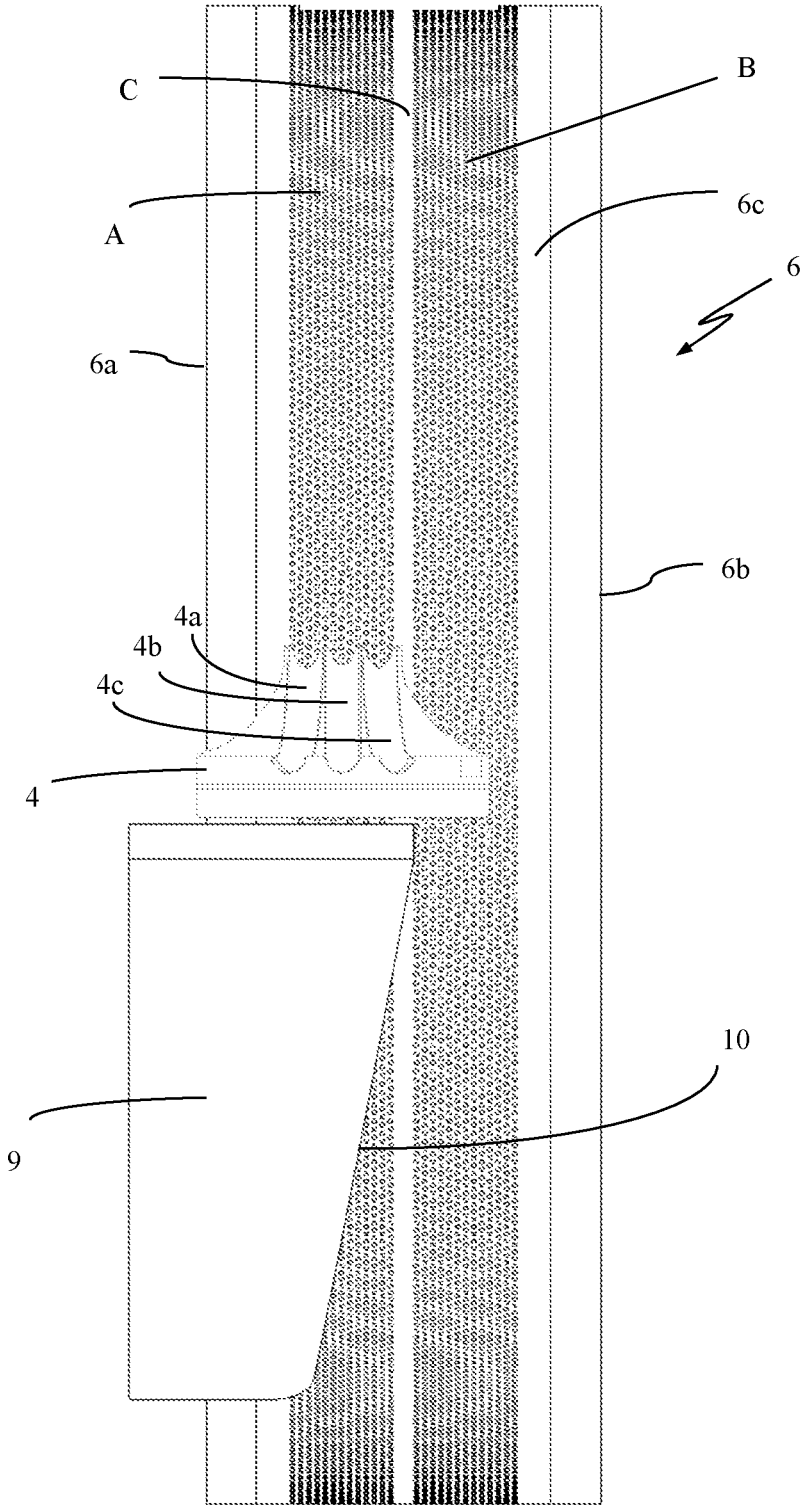
FIG. 4 shows a top view of a cooling drum, the discharge unit of a texturing unit and a guide piece for moving the yarn plugs on the cooling surface, of a device for manufacturing crimped synthetic yarn.

Before the yarn plugs (1), (2), (3) start on the second turn on the cooling surface, they hit an inclined guide wall (10) arranged above the cooling surface and forming part of a guide element (9)—see FIG. 4—as a result of which they are moved to the second zone (B) of the cooling surface. As a result thereof, an intermediate space (T) is formed between the third yarn plug (3) of the first winding (I) and the first yarn plug (1) of the second winding (II). This intermediate space (T) is at least equal to the width (c) of the intermediate zone (C). During their second turn, the yarn plugs (1), (2), (3) are lead away from the cooling surface (6*c*) at a greater speed than the supply speed of the yarn plugs. As a result thereof, the yarn plugs are transformed into a crimped synthetic yarn.

Figure 5:
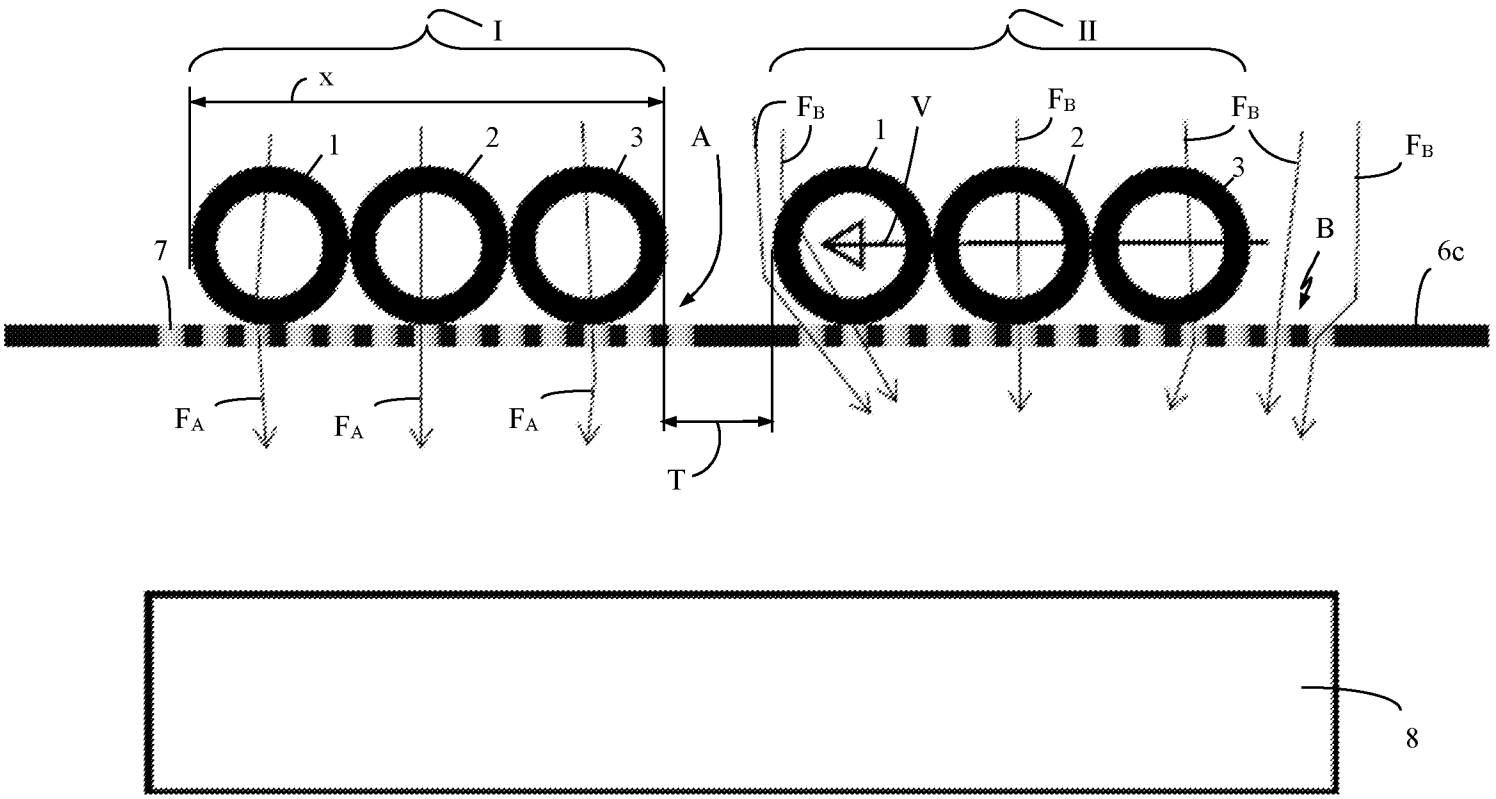
FIG. 5 shows a diagrammatic cross section of the cooling surface of the cooling drum on which two windings of a group of three yarn plugs running alongside each other are arranged.

The diagrammatic cross section of FIG. 5 shows the first (I) and the second winding (II) of the yarn plugs (1), (2), (3) which are situated on the first zone (A) and the second zone (B) of the cooling surface (6*c*), respectively.

The air stream ($F_B$) through the perforations (7) in the second zone ensures, on the one hand, that the yarn plugs are securely kept in the second zone. Due to the fact that an air stream is generated in this second zone and not in the intermediate zone, air streams ($F_B$) having a lateral flow direction in the direction of the second zone (B) are generated in the boundary region of the intermediate zone, in the vicinity of the boundary between the second zone and the intermediate zone (C). As a result thereof, a yarn plug which has a tendency to move from the second zone in the direction of the first zone along the direction (V) indicated in FIG. 5 will come under the influence of said lateral gas streams ($F_B$) in this boundary region, as a result of which its displacement is counteracted.

As a result thereof, the risk of the first yarn plug (1) of the second winding (II) or the yarn pulled away therefrom moving laterally from the second zone (B) and interfering with the third yarn plug (3) of the first winding (I) situated in the first zone (A) is extremely small. As a result thereof, the risk of interference is much reduced and the risk of internal differences in the yarn quality of simultaneously produced synthetic yarns is greatly reduced.

Figure 6:
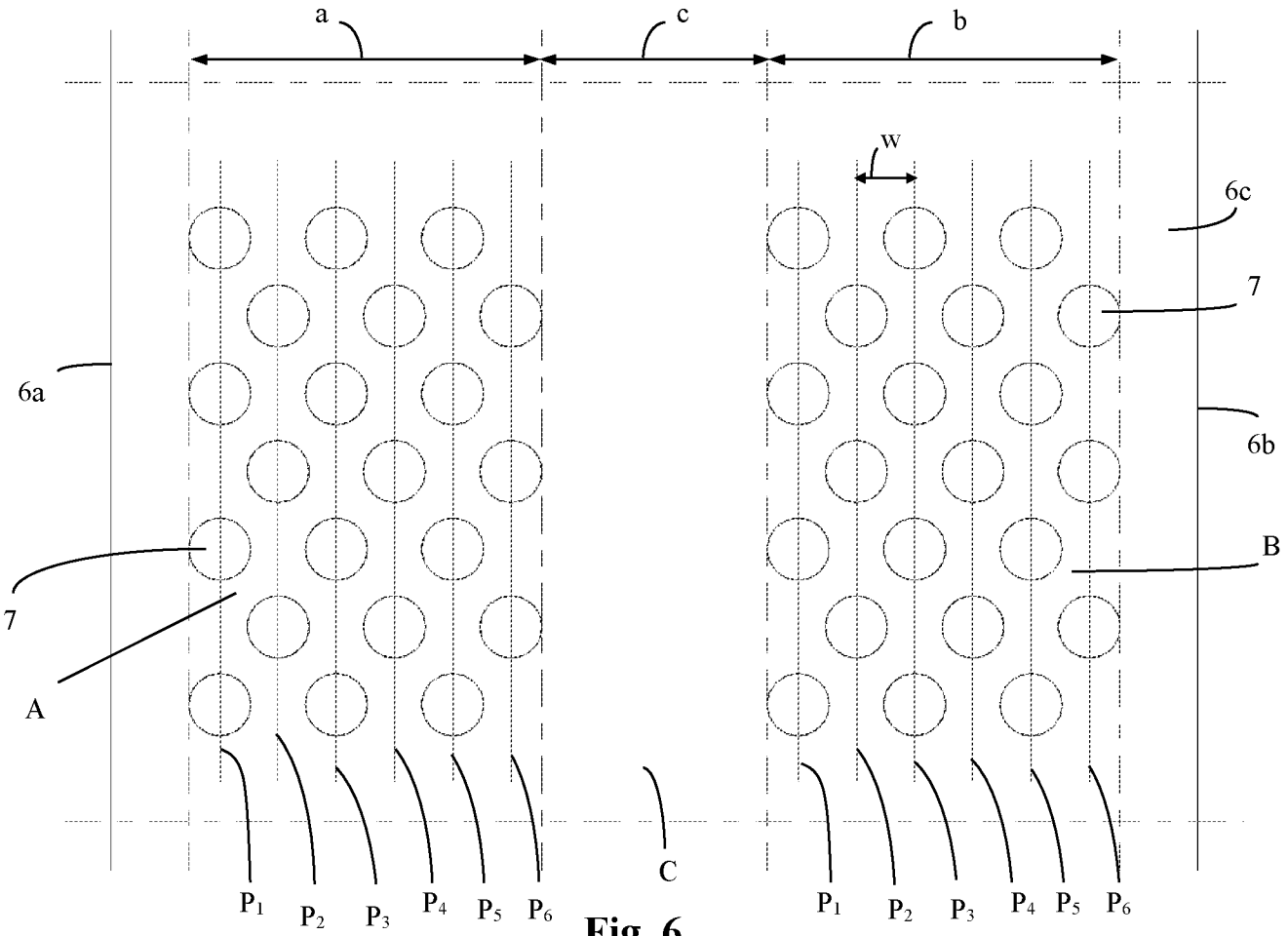
FIG. 6 shows a diagrammatic representation of part of the cooling surface with an indication of a possible arrangement of the perforations.

FIG. 6 diagrammatically shows a possible arrangement of the perforations in the first and the second zone on a section of the cooling surface. The perforations are distributed over six parallel position lines with a mutually perpendicular intermediate space (w). These position lines run parallel with the edges of the cooling surface (6*c*) and are also at right angles to the axis (L) of the cooling drum (6). The perforations (7) are arranged in successive rows of three, there being, in successive rows, alternately only openings (7) on the first ($P_1$), the third ($P_3$) and the fifth position line ($P_5$) in one row and in the other row only openings (7) on the second ($P_2$), the fourth ($P_4$) and the sixth position line ($P_6$).

The invention claimed is:

1. A device for manufacturing crimped textile yarn, comprising:

a texturing unit provided to produce at least two yarn plugs from synthetic material, a rotatable cooling drum with a cooling surface for cooling the yarn plugs supplied from the texturing unit, and a gas stream generator provided to generate a gas stream to keep the yarn plugs on the cooling surface, wherein the device is configured:

to place the supplied yarn plugs next to each other in a first zone of the cooling surface on the rotating cooling drum, so that they are carried along running alongside each other on the cooling surface, to move the yarn plugs running alongside each other laterally to a second zone of the cooling surface during their first turn on the cooling drum, so that the supplied yarn plugs are placed on the cooling surface at an intermediate distance from the yarn plugs running alongside each other which have been moved to the second zone, and to lead the yarn plugs away from the cooling drum for their further treatment after forming more than one winding of yarn plugs running alongside each other on the cooling drum, wherein the gas stream generator is configured to generate a gas stream in the second zone of the cooling surface, so that the yarn plugs in this second zone are kept on the cooling surface, and either (A) not to generate a gas stream in an intermediate zone of the cooling surface, situated between the first and the second zone, or (B) to generate a gas stream which is less powerful in the intermediate zone than in the second zone, in order to prevent interference between the yarn plugs in the second zone and the yarn plugs in the first zone.

2. The device for manufacturing crimped textile yarn according to claim 1, characterized in that the cooling surface in the second zone is permeable to gas, and in that the gas stream generator is configured to generate a gas stream through the second zone of the cooling surface which is directed towards the cooling surface.

3. The device for manufacturing crimped textile yarn according to claim 1, characterized in that the cooling surface in the first zone is permeable to gas, and in that the gas stream generator is configured to generate a gas stream through the first zone of the cooling surface which is directed towards the cooling surface.

4. The device for manufacturing crimped textile yarn according to claim 2, characterized in that the cooling surface in the intermediate zone is less permeable to gas than in the second zone or is not permeable to gas.

5. The device for manufacturing crimped textile yarn according to claim 4, characterized in that the cooling surface in the intermediate zone is less permeable to gas than in the first zone.

6. The device for manufacturing crimped textile yarn according to claim 1, characterized in that the width of the intermediate zone is at least equal to the intermediate distance.

7. The device for manufacturing crimped textile yarn according to claim 1, characterized in that the first and the second zone of the cooling surface are separated from one another by the intermediate zone over at least part of the circumference of the cooling surface.

8. The device for manufacturing crimped textile yarn according to claim 7, characterized in that the first zone and the second zone of the cooling surface form a respective band which extends over the circumference of the cooling surface and has a width which is at least equal to the width of the yarn plugs running alongside each other.

9. The device for manufacturing crimped textile yarn according to claim 1, characterized in that the cooling surface is a flat and uninterrupted surface.

10. The device for manufacturing crimped textile yarn according to claim 1, characterized in that one or more openings or perforations are provided in the first zone and in the second zone of the cooling surface, whereas the cooling surface in the intermediate zone is substantially closed.

11. The device for manufacturing crimped textile yarn according to claim 2, characterized in that the gas stream generator comprises a drawing-in device in order to create an underpressure under the cooling surface which generates an air stream which is directed from a top side of the cooling surface towards the cooling surface and flows through at least one gas-permeable zone thereof.

12. The device for manufacturing crimped textile yarn according to claim 1, characterized in that the device comprises a guide wall which extends above the cooling surface at an angle in order to guide the yarn plugs running alongside each other to said second zone before they enter the second turn on the cooling surface.

13. The device for manufacturing crimped textile yarn according to claim 9, characterized in that the flat and uninterrupted surface lacks any raised or lowered portions that change a diameter of the flat and uninterrupted surface.

14. A method for manufacturing crimped textile yarn, comprising:

producing at least two yarn plugs from synthetic material in a texturing unit, placing the yarn plugs in a first zone on a cooling surface of a rotating cooling drum, so that they are carried along running alongside each other on the cooling surface, moving the yarn plugs running alongside each other laterally to a second zone on the cooling surface during their first turn on the cooling drum, keeping the yarn plugs on the cooling surface by means of a gas stream, and leading the yarn plugs running alongside each other away from the cooling drum for further treatment after having formed more than one winding, wherein the yarn plugs in the second zone are kept on the cooling surface by a gas stream, and either (A) no gas stream is generated in an intermediate zone of the cooling surface, situated between the first and the second zone, or (B) a gas stream is generated which is less powerful in the intermediate zone than in the second zone, in order to prevent interference between the yarn plugs in the second zone and the yarn plugs in the first zone.

15. The method for manufacturing crimped textile yarn according to claim 14, characterized in that the yarn plugs in the second zone are kept on the cooling surface due to the fact that the cooling surface in the second zone is permeable to gas, and a gas stream is generated which is directed towards the cooling surface and flows through the second zone of the cooling surface.

16. The method for manufacturing crimped textile yarn according to claim 14, characterized in that the yarn plugs in the first zone are kept on the cooling surface due to the fact that the cooling surface in the first zone is permeable to gas, and a gas stream is generated which is directed towards the cooling surface and flows through the first zone of the cooling surface.

17. The method for manufacturing crimped textile yarn according to claim 15, characterized in that the cooling surface in the intermediate zone is less permeable to gas than in the second zone.

18. The method for manufacturing crimped textile yarn according to claim 14, characterized in that an underpressure is created under the cooling surface to generate an air stream which is directed from a top side of the cooling surface towards the cooling surface and flows through at least one gas-permeable zone thereof.

* * * * *